United States Patent [19]

Petros

[11] 4,105,172

[45] Aug. 8, 1978

[54] TENSION REEL FOR STRIP COILING

[75] Inventor: Andrew J. Petros, Oakdale, Pa.

[73] Assignee: Mesta Machine Company, Pittsburgh, Pa.

[21] Appl. No.: 776,529

[22] Filed: Mar. 11, 1977

[51] Int. Cl.[2] ..... B21C 47/02; B65H 75/24

[52] U.S. Cl. ..... 242/78.1; 242/72.1; 242/81

[58] Field of Search ..... 242/78.3, 72 R, 78.1, 242/72.1, 81, 79

[56] References Cited

U.S. PATENT DOCUMENTS

| | | | |
|---|---|---|---|
| 2,117,640 | 5/1938 | Wean et al. | 242/78.1 |
| 2,936,132 | 5/1960 | Tracy | 242/78.1 |
| 2,943,807 | 7/1960 | Loop | 242/72.1 |
| 3,116,891 | 1/1974 | Anderson et al. | 242/72.1 |
| 3,712,446 | 1/1973 | Hengelhaupt et al. | 242/81 |

*Primary Examiner*—George F. Mautz

*Attorney, Agent, or Firm*—Carothers and Carothers

[57] ABSTRACT

A tension reel for strip coiling which includes a continuous double expansible mandrel rotatably supported at opposite ends to a frame. The double expansible mandrel consists of two expansible mandrel sections joined endwise in axially separable drive engagement such that rotation of one mandrel section for strip coiling also drives the other mandrel section when they are axially joined in driving engagement. Means are provided to axially engage and retract the mandrel sections relative to each other to remove the coiled strip from between the divided and collapsed mandrel sections.

7 Claims, 3 Drawing Figures

TENSION REEL FOR STRIP COILING

BACKGROUND OF THE INVENTION

This invention relates generally to strip coilers or uncoilers and more particularly to tension reels for cold strip coilers having an expansible mandrel which engages the eye of a coil after several original wraps have been made.

A single mandrel tension reel is generally used at the delivery end of a cold strip reduction mill for strip coiling. The use of such single mandrel tension reels for coiling strip in modern cold strip reduction mills presents a number of problems which are mainly due to the weight of the coils to be handled and also to the high speeds at which the strip issues from the mill. First, excessive time is required to remove the finished coil from one end of the tension reel. Secondly, mandrel deflection is experienced due to excessive forces over the mandrel length which can create defects in the coil and impose undue wear on the mandrel bearings which support the mandrel at one end. In this regard, when excessively heavy coils are being wrapped on the tension reel, it is also necessary to provide an outboard bearing support on the normally unsupported end of the tension reel mandrel. In addition, expensive heavy duty mandrel bearings are required to support the coil.

Conventional tension reels also require the use of expensive coil stripper equipment to remove the coils from the tension reel mandrel for further processing. Furthermore, where coil sleeves are used, considerable valuable time is consumed in mounting the next sleeve into position endwise over the mandrel. All of the foregoing disadvantages obviously reduce the production efficiency of the cold strip reduction mill and require the expenditure of additional initial capital outlay. It is a principle object of the present invention to eliminate or at least minimize all of the aforesaid disadvantages of the tension reels for strip coiling of the prior art.

SUMMARY OF THE INVENTION

The tension reel for strip coiling of the present invention includes a rigid frame adapted to receive the end of a strip to be coiled and a continuous double expansible mandrel which is rotatably mounted at opposite ends to the frame and consists of two expansible mandrel sections which are joined endwise in axially separable drive engagement. Means are provided to radially expand and collapse the mandrel sections and additional means are provided to rotatably drive one of the expandable mandrel sections for strip coiling on the double mandrel when the mandrel sections are axially joined in driving engagement. Means also are provided to axially engage and retract the mandrel sections relative to each other. Thus, after an entire strip has been coiled or processed, the driven rotation of the tension reel is stopped, and the two mandrel sections or assemblies are collapsed after the coil has been engaged for support thereunder by a coil delivery car. The collapsed mandrel sections are then axially separated relative to each other to clear the coil such that it can then be removed by the coil car in a direction transverse to the axis of the mandrel.

Accordingly, less mandrel deflection is experienced because the mandrel sections are shorter than single mandrels of the prior arts, and in addition, no outboard bearing support is required, as both ends of the continuous double mandrel are permanently journaled in bearings. This also permits the use of lower rated mandrel bearings than those required for mandrels of the prior art due to the fact that the coil load is borne by four bearings as opposed to two bearings of the prior art tension reels. In addition, the tension reel of the present invention eliminates the requirement for a coil stripper to remove the coil from the tension reel.

The double mandrel tension reel of the present invention is further characterized by the incorporation of axial guide or alignment means to insure that the mandrel sections accurately align in proper cross sectional drive and central support engagement.

An additional advantage is also provided in that more accurate machining of the two shorter mandrel sections is made possible in manufacturing the mandrel as compared to the single, longer tension reel mandrels of the prior art.

Mill coil delivery reels have been provided in the past in the form of two separated or spaced mandrel sections which engage opposite ends of the eye of a coil to be processed in the mill. However, they are obviously undesirable for use as a tension reel for strip coiling, as there is no axial engagement of the mandrel sections. This spacing gap between mandrel sections and the lack of accurate assurance that the mandrel sections are axially aligned renders such delivery reels undesirable for coiling tension reels, as coil defects would be inevitable.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DESCRIPTION OF THE PREFERRED EMBODIMENTS

Figure 1:
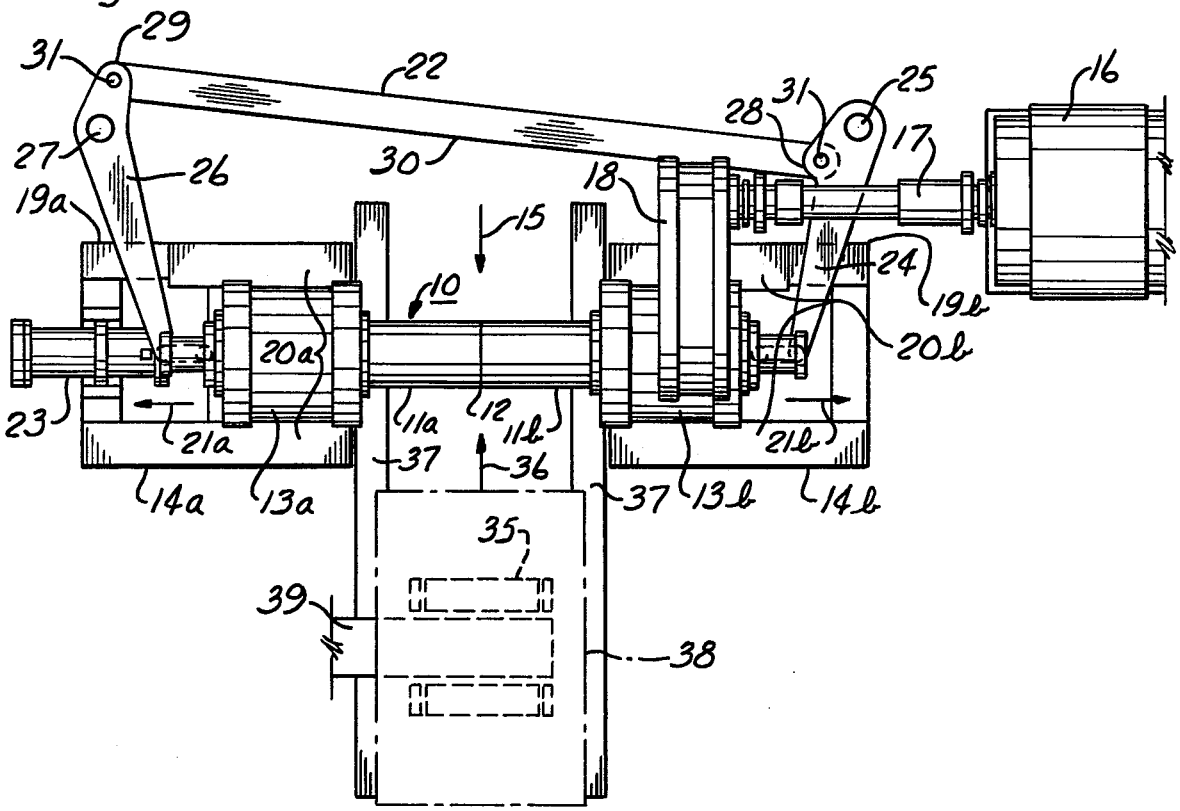
FIG. 1 is a diagrammatic plan view of the continuous double mandrel tension reel of the present invention.

Referring to FIG. 1 of the drawings, the tension reel 10 of the present invention consists of two identical opposed mandrel assemblies 11*a* and 11*b* which mesh or meet at the center 12 of the tension reel 10 in axial driving engagement. Each mandrel assembly 11*a* and 11*b* is respectively mounted and journaled in its housing 13*a* and 13*b*, which are in turn, mounted on two similar frames 14*a* and 14*b*. These frames are, in turn, foundation mounted perpendicular to the center line of the mill indicated by the strip feed arrow 15 and at the delivery side of the last mill stand (not shown). Metal strip is fed from the mill as indicated by arrow 15 and initial wraps of the feed end of the strip to be coiled are made about rotating tension reel 10 with the assistance of a conventional belt wrapper (not shown). Once the initial wraps of the strip material have been made about tension reel 10 with the assistance of the belt wrapper, belt wrapper assistance is no longer required, and the coiling tension about tension reel 10 is supplied solely by the driven tension reel 10 itself.

Mandrel assembly 11b is driven by stationary mounted electrical motor 16 which is connected through an axial slide type coupling 17, which in turn is connected in driving engagement to an integral gear reducer 18. Gear reducer 18 is, in turn, mounted to housing 13b and rotatably drives mandrel assembly 11b journaled for rotation in housing 13b. Thus, only one mandrel assembly 11b is motor driven and the other mandrel assembly 11a is driven through meshing end plates attached to the mandrel assembly ends where they engage or meet at 12. These end plates, as will be explained in further detail hereinafter, have fine gear teeth machined on their face that engage or intermesh when the tension reel is positioned in its closed or coiling position as indicated in FIG. 1 such that mandrel assemblies 11a and 11b are meshed in driving engagement at 12.

Frames 14a and 14b consist of rigid foundation supported portions 19a and 19b and slidable frame portions 20a and 20b. Slidable frame portions 20a and 20b are adapted to slide outwardly as indicated respectively by arrows 21a and 21b on stationary frames 19a and 19b respectively by means of guided liners or rollers (not shown). Housings 13a and 13b are respectively rigidly secured to slidable frame sections 20a and 20b such that the tension reel 10 may be separated at its center 12 by simultaneously separating housings 13a and 13b together with their respective slidable frame portions 20a and 20b in the direction indicated by arrows 21a and 21b. The two mandrel assemblies 11a and 11b of tension reel 10 together with their respective housings 13a and 13b and slidable frame portions 21a and 21b slide simultaneously on foundation mounted frames 19a and 19b towards or away from each other through the action of an independent toggle mechanism 22 attached to each housing 13a and 13b. The toggle mechanism 22 is powered by a stationary mounted hydraulic cylinder 23 attached to housing 13a.

Toggle mechanism 22 consists of lever arm 24 which is pivotally connected at one end to housing 13b and pivotally mounted at the other end about shaft 25. At the other end of toggle mechanism 22 is provided a lever arm 26 which is pivotally secured at one end to housing 13a and is also mounted for pivotal movement about shaft 27. Lever arm 24 has an ear 28 which is positioned inboard of shaft 25 and in an opposite manner, lever arm 26 is provided with an ear 29 positioned outboard of its respective pivot shaft 27. The rigid linkage arm 30 connects ear 28 with ear 29 through means of pivotal connections 31 and 32 respectively.

Due to this toggle mechanism arrangement, it can thus be readily visualized that when hydraulic cylinder 23 draws housing 13a to the left in FIG. 1 as indicated by arrow 21a, toggle mechanism 22 imparts a like action to housing 13b such that housing 13b moves outwardly as indicated by arrow 21b for the same distance which housing 13a moves.

When housing 13b either moves in or out, gear reducer 18 moves with housing 13b as it is rigidly secured thereto. The axial displacement incurred between stationary motor 16 and moving gear 18 is absorbed in slide shaft coupling 17.

In order to acquire a better understanding of the operation of the tension reel of the present invention, a sequence of the occurence of the events for the coiling operation is described. During strip coil buildup at the tension reel 10, delivery coil car 35 is driven in as indicated by arrow 36 on rails 37 such that it is positioned in waiting on the center line of the mill directly under tension reel 10. Upon proper command indicating that the coiling operation is about completed, the delivery coil car lifts upward or elevates underneath to engage the coil under reduced pressure for tailing out of the strip coil. Rotation of the tension reel is stopped and the delivery car lift fully engages and supports the coil 38 and is thus held in this holding mode. The mandrel assemblies 11a and 11b are of the collapsible type and are then radially collapsed in a conventional manner and thereafter the mandrel assemblies are axially retracted in accordance with the teachings of the present invention to clear the coil 38 together with its coiling sleeve if such a sleeve is employed upon the tension reel 10 before coiling.

Once the collapsed mandrels have been collapsed and cleared of the coil, the delivery coil car then moves together with its coil load thereon to the delivery walking beam position as indicated in FIG. 1. At this position, the coil 38 may then be moved laterally by walking beam 39 for additional operation to be performed on the coil 38 such as banding.

As soon as the coil is clearing the separated mandrel assemblies 11a and 11b, a sleeve handling device may be employed to position a sleeve, if required, in position between the spaced mandrel assemblies 11a and 11b. The mandrel assemblies 11a and 11b are then brought inwardly and axially engage while simultaneously axially sliding in to the new coiling sleeve (not shown). The mandrel assemblies are then expanded and the belt wrapper (not shown) moves downward to the tension reel in position such that the tension reel is ready to receive the leading end of the strip material for the next coil.

Figure 3:
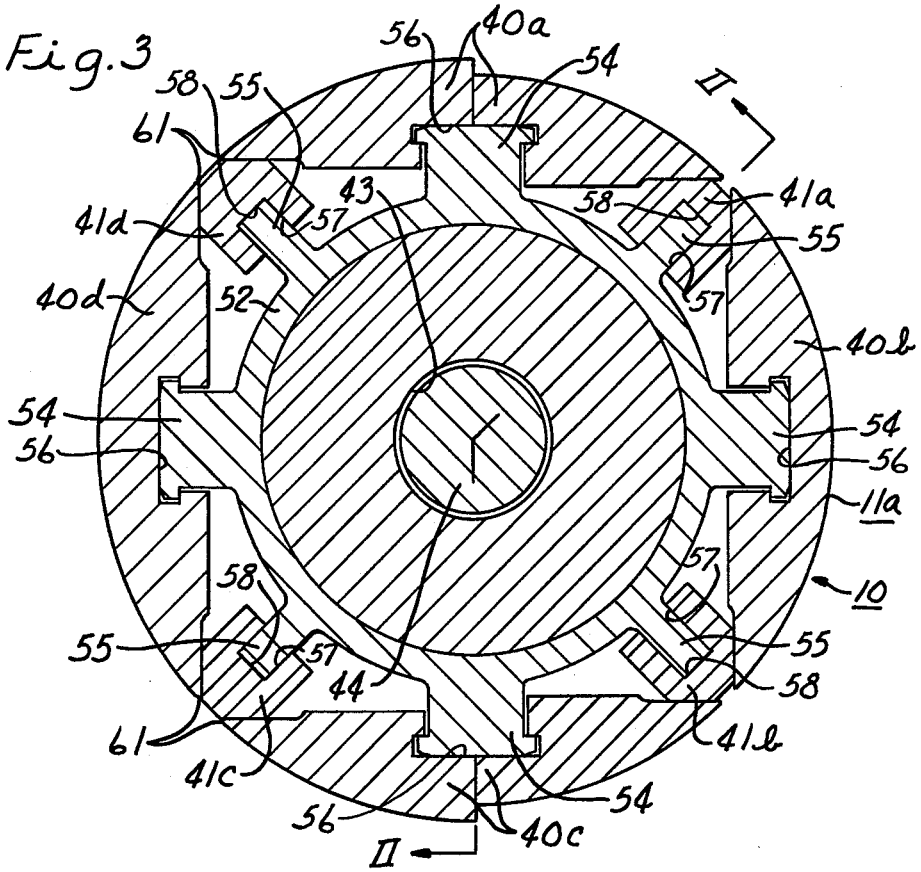
FIG. 3 is a vertical cross section of the double mandrel of FIG. 2 as seen along section line III—III of FIG. 2.
Figure 2:
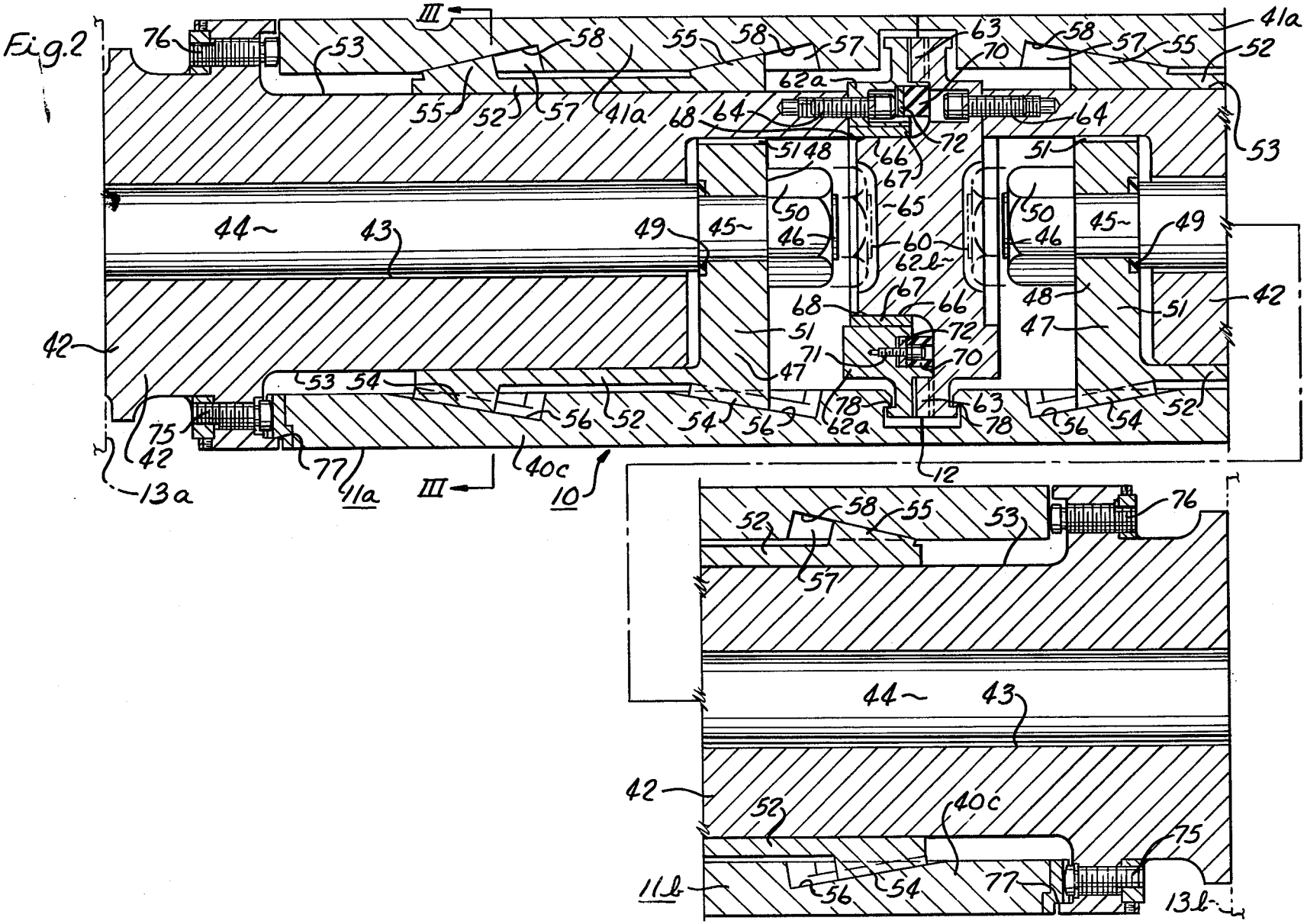
FIG. 2 is an enlarged vertical section through the axis of the double mandrel of FIG. 1 as seen along section line II—II of FIG. 3.

FIGS. 2 and 3 depict enlarged cross sections of the tension reel 10 illustrated in FIG. 1. Each mandrel assembly 11a and 11b making up the tension reel 10 consists of four outer expansion mandrel segments 40a, 40b, 40c and 40d, and four fillers or spreaders 41a, 41b, 41c, and 41d, which fill the outer circumferential gap created between the respective mandrel segments 40a through 40d when they are in their expanded position to provide a smooth perfect circle outer circumference mandrel surface. For the purpose of explanation, the right half of mandrel assembly 11a illustrated in FIG. 3 illustrates the mandrel assembly in its collapsed condition, whereas the left half of the sectional view of FIG. 3 is illustrated in its fully expanded position. In reality, to correctly illustrate the vertical section of FIG. 3 as seen along line III—III of FIG. 2, the vertical section of FIG. 3 should also be illustrated in its fully expanded position in both halves of the figure.

The expansible mandrel assemblies of each mandrel section are mounted on respective rotatable core or mandrel bodies 42 each having an elongated central bore 43 therethrough in which the actuating shafts 44 are positioned, such actuating shafts each having a reduced portion 45 which terminated in a threaded end portion 46. Secured on the outer ends of each shaft 44 (or on the inner ends of said shafts relative to the entire tension reel 10) is a four armed spider or cross head 47 having a hub portion 48 which is seated against annular shoulder 49 of each shaft 44 and retained in position by means of nut 50 which is threadably received on the threaded portion 46 of the shaft.

The spider arms 51 of each cross head 47 are four in number and respectively pass through corresponding openings or slots in mandrel body 42 and thereupon are integrally attached to wedge ring 52 which is in the form of a sleeve slidably received on the outside cylindrical surface 53 of mandrel body or core 42.

Wedge ring or sleeve 52 is provided with a series of segment sliding wedges 54 and a series of filler sliding wedges 55. Sliding segment wedges 54 are keyed into mandrel segments 40*a* through, 40*d*, and mate in sliding engagement with inclined surfaces 56 within the corresponding mandrel segments.

In a similar manner, filler wedges 55 are received in corresponding recesses 57 and their outward inclined surfaces mate in sliding engagement with incline surfaces 58 of each recess 57 within the respective mandrel filler segments 41*a* through 41*d*.

The outside ends of actuating shafts 44 of each mandrel assembly are connected to respective rotating hydraulic cylinders attached respectively on housings 13*a* and 13*b*. These hydraulic cylinders provide the axial movement of actuating shafts 44 relative to the mandrel core 42 in order to expand and collapse the mandrel assemblies through the series of segment wedges 54 and filler wedges 55. Tension reel 10 as illustrated in FIG. 2 is shown in its expanded condition. By actuating the aforementioned rotating hydraulic cylinders to correspondingly axially move actuating shafts 44 inwardly toward each other to the respective positions indicated at 60, the tension reel 10, or the two mandrel assemblies are collapsed. The collapsed condition of the mandrel assemblies is illustrated in the right half of the cross sections of FIG. 3. The collapsed condition is, of course, brought about by the fact that segment wedges 54 and filler wedges 55 also move inwardly towards the center 12 of the tension reel, thereby simultaneously drawing in all four mandrel segments 40*a* through 40*d*, due to the fact that segment wedges 54 are keyed to their respective inclined surfaces 56. At the same time, filler segments 41*a* through 41*d* are radially retracted within the collapsing mandrel segments as the inclined surfaces 58 of filler segments 41*a* through 41*d* are riding down the mating inclined surfaces of filler wedges 55 as the actuating shafts 44 together with wedge sleeves 52 move inwardly towards the center 12 of the tension reel.

Unlike many conventional expandable mandrels, the expandable mandrel assemblies 11*a* and 11*b* provide a truly circular cross section when fully expanded with no undesirable gaps remaining between the separated edges 61 which could otherwise cause defects in the strip coil being wrapped thereon due to the filling of these gaps by the respective filler segments 41*a* through 41*d* as best illustrated in the left-hand side of FIG. 3.

As illustrated in FIG. 2, the two expansible mandrel sections or assemblies 11*a* and 11*b* are joined endwise in axially separable drive engagement at 12 through respective annular meshing end plates 62*a* and 62*b*. These end plates mesh in driving engagement by means of an annular series 63 of fine gear teeth machined on the opposing faces of the end plates.

Annular end plates 62*a* and 62*b* are secured to the ends of the respective mandrel cores 42 by means of bolts 64. In addition, to insure that the mandrel assemblies or sections 11*a* and 11*b* axially mate with each other as indicated at 12 in accurate cross sectional alignment, end plate 62*b* is provided with annular alignment projection or nose 65 which is slidably received in annular alignment bore 66 of end plate 62*a*. A replacable liner 67 is utilized to form bore 66 within end plate 62*a* to permit replacement of the sleeve liner 67 with wear. In addition, the forward end of nose 65 is provided with an annular bevel 68 for initial ease of insertion of alignment nose 65 into sleeve 67.

In order to cushion the initial impact shock created when mandrel assemblies 11*a* and 11*b* are axially engaged with each other at 12, shock absorbers or cushions 70 are secured to end plate 62*a* by means of bolts 71. Fillers or shims 72 are also provided to permit proper adjustment of the shock absorbers or cushions 70.

When the mandrel assemblies or sections 11*a* and 11*b* are thus meshed in driving engagement, such that the alignment nose or projection 65 is received in alignment bore 66, a continuous single expansible mandrel is provided. Gap between the axial mandrel segments is also kept to an absolute minimum due to the ability to adjust the travel of the axially engaging mandrel sections with shims 72 for shock absorbing pads 70. Thus meshed in driving engagement, mandrel assembly or section 11*a* acts as the drive mandrel and mandrel assembly 11*a* is the driven or idler mandrel assembly.

At the outside ends of each expansible mandrel assembly, adjusting screws 75 and 76 are provided which permit final adjustment of the mandrel segments 40*a* through 40*d* and filler segments 41*a* through 41*d* to insure that the entire tension reel 10 will maintain an accurate and constant circular cross section throughout. Proper alignment of the mandrel segments 40*a* through 40*d* is further insured by means of the outside stops 77 on mandrel body or core 42 and inside stops 78 on end plates 62*a* and 62*b* when the mandrel segments are in their fully expanded position.

I claim:

1. A strip coiler comprising a rigid frame, a continuous double expansible mandrel rotatably mounted at opposite ends to said frame to receive the end of a strip to be coiled and consisting of two expansible mandrel sections joined endwise in axially separable drive engagement by a plurality of interengaging axially entending projections, means operable to expand and collapse said mandrel sections, drive means connected to rotatably drive one of said mandrel sections and thereby drive both of said mandrel sections in unison for strip coiling on said double mandrel when said mandrel sections are axially joined in driving engagement, means operable to axially engage and retract said mandrel sections relative to each other, each of said expansible mandrel sections including a plurality of radially collapsable mandrel segments symmetrically positioned about respective mandrel cores, and stop means to permit independent adjustment of said mandrel segments relative to said cores to provide a perfect circle mandrel cross section of said double mandrel when said mandrel sections are expanded.

2. The strip coiler as claimed in claim 1 including alignment means in the axially engaging ends of said mandrel sections to insure accurate cross-sectional mating of said mandrel sections.

3. The strip coiler as claimed in claim 2 wherein said alignment means consists of an annular alignment projection secured to the axially engaging end of one mandrel section and a corresponding alignment bore in the engaging end of the other of said mandrel sections to receive said projection in axial alignment.

4. The strip coiler as claimed in claim 2 wherein said axially extending projections are intermeshing teeth on the respective mating ends of said mandrel section.

5. The strip coiler of claim 1 wherein each of said mandrel cores axially intermesh with each other to provide said separable drive engagement and each slidably receiving a coaxial shaft, a cross head secured to the opposing inside ends of said shafts, each of said cross heads having a plurality of spider arms extending through longitudinal slots in said cores for axial movement relative thereto, a sleeve slidably received on each of said cores and respectively secured to said spider arms of respective of said cross heads, and wedge means interconnecting said mandrel segments with said respecitve sleeves on mating inclined slide surfaces operable to radially expand or collapse said segments simultaneously with axial movement of said shafts relative to said cores.

6. The strip coiler of claim 5 including filler segments positioned to fill the gaps created between circumferentially adjacent of said mandrel segments when expanded, and second wedge means interconnecting said filler segments with said respective sleeves on second mating inclined slide surfaces operable to radially expand or collapse said filler segments in cooperation with said mandrel segments.

7. The strip coiler of claim 6 including second stop means to permit independent adjustment of said filler segments relative to said cores to provide for perfect circle cross section of said double mandrel when said mandrel sections are expanded.

* * * * *